US008856966B2

(12) United States Patent
Doty

(10) Patent No.: US 8,856,966 B2
(45) Date of Patent: Oct. 14, 2014

(54) SCRATCHING DEVICE

(76) Inventor: Pamela A. Doty, Point Pleasant, NJ (US)

( * ) Notice: Subject to any disclaimer, the term of this patent is extended or adjusted under 35 U.S.C. 154(b) by 1289 days.

(21) Appl. No.: 11/289,958

(22) Filed: Nov. 30, 2005

(65) Prior Publication Data

US 2007/0118968 A1 May 31, 2007

(51) Int. Cl.
*A41D 19/00* (2006.01)
*A61H 7/00* (2006.01)

(52) U.S. Cl.
CPC ..... *A61H 7/003* (2013.01)
USPC ..... 2/160; 2/163; 119/600

(58) Field of Classification Search
None
See application file for complete search history.

(56) References Cited

U.S. PATENT DOCUMENTS

| | | | | | |
|---|---|---|---|---|---|
| 137,771 | A | * | 4/1873 | Gash | 30/123.5 |
| 687,363 | A | | 11/1901 | Wirt | |
| 869,250 | A | | 10/1907 | Martin | |
| 1,010,283 | A | * | 11/1911 | Loy | 2/163 |
| 2,114,022 | A | * | 4/1938 | Jensen | 2/16 |
| 2,118,360 | A | * | 5/1938 | Sager | 2/20 |
| 2,335,320 | A | * | 11/1943 | Swietek | 2/163 |
| 2,725,570 | A | * | 12/1955 | Penna | 2/163 |
| 2,729,023 | A | | 1/1956 | Leer et al. | |
| 2,923,946 | A | * | 2/1960 | Nielsen | 2/158 |
| 2,954,832 | A | * | 10/1960 | Pirone | 172/370 |
| 4,091,805 | A | | 5/1978 | Clark | |
| 4,149,601 | A | * | 4/1979 | Taylor | 172/370 |
| 4,766,914 | A | * | 8/1988 | Briggs | 132/212 |
| 4,867,246 | A | * | 9/1989 | Kiger | 172/370 |
| 4,893,955 | A | | 1/1990 | Zielinski | |
| 5,022,093 | A | | 6/1991 | Hall | |
| 5,107,562 | A | * | 4/1992 | Dunn | 15/167.1 |
| 5,676,092 | A | | 10/1997 | Ortolivo | |
| 5,682,837 | A | | 11/1997 | Courtney et al. | |
| 5,687,424 | A | * | 11/1997 | Masley | 2/163 |
| 5,779,653 | A | | 7/1998 | Thompson | |
| 5,800,446 | A | | 9/1998 | Banuchi | |
| 6,058,510 | A | * | 5/2000 | Breitenbach | 2/161.6 |
| 6,109,070 | A | | 8/2000 | Chen | |
| 6,374,417 | B1 | * | 4/2002 | Stagnitta | 2/161.8 |
| 6,830,552 | B1 | | 12/2004 | Gonzalez | |
| 6,912,731 | B2 | * | 7/2005 | Cass | 2/161.1 |
| 6,968,808 | B2 | | 11/2005 | Claire | |
| 2004/0221365 | A1 | | 11/2004 | Fitzgerald | |

FOREIGN PATENT DOCUMENTS

| | | |
|---|---|---|
| JP | 11-114010 A | 4/1999 |

* cited by examiner

*Primary Examiner* — Katherine Moran
(74) *Attorney, Agent, or Firm* — Alan Taboada; Moser Taboada

(57) ABSTRACT

Embodiments of a scratching device are provided herein. In one embodiment, a scratching device includes a hand cover and a means for scratching disposed proximate a terminal end of the hand cover. The hand cover may be configured as a glove, a mitten, or the like and may further be configured to resemble a human hand, an animal's paw, or an element of nature. The means for scratching generally includes a scratching element that extends from a terminal portion of the hand cover. The means for scratching may further comprise a body coupled to the scratching element and having one or more holes configured for the fingers of the user. Optionally, an insert having one or more holes configured for the fingers of the user may be placed within the hand cover to facilitate control of the means for scratching.

21 Claims, 2 Drawing Sheets

SCRATCHING DEVICE

BACKGROUND OF THE INVENTION

1. Field of the Invention

Embodiments of the present invention generally relate to a device for scratching pets and/or humans.

2. Description of the Related Art

Pets seem to love a good scratch, and scratching a pet is a great bonding experience for the pet and the person giving the scratch. Scratching may be performed with the human hand, or with some other device. For example, many devices that have been invented or are used to scratch humans, such as backscratchers and the like, may also be used to scratch a pet, such as dogs, cats, and the like. However, these devices do not seem to provide the same enjoyment to both pet and owner as scratching with a human hand.

Unfortunately, some pet owners may not be able to or may not desire to scratch their pets with their bare hands. For example, some people do not have long nails and, therefore, cannot provide a good scratch. Others may have sufficient nails, but may be reluctant to scratch their pets for other reasons, such as having allergies, aversions to dirt, recently manicured nails, and the like.

Therefore there is a need for a device for scratching pets.

SUMMARY OF THE INVENTION

The present invention generally provides a device for scratching that fits over the hand of the user and having attachments configured for scratching. In one embodiment, a scratching device includes a hand cover and a means for scratching disposed proximate a terminal end of the hand cover. The hand cover may be configured as a glove, a mitten, or the like and may further be configured to resemble a human hand, an animal's paw, or an element of nature. The means for scratching generally includes a scratching element that extends from a terminal portion of the hand cover. The means for scratching may further comprise a body coupled to the scratching element and having one or more holes configured for the fingers of the user. Optionally, an insert having one or more holes configured for the fingers of the user may be placed within the hand cover to facilitate control of the means for scratching.

BRIEF DESCRIPTION OF THE DRAWINGS

The teachings of the present invention will become apparent by considering the following detailed description in conjunction with the accompanying drawings, in which.

Figure 1:
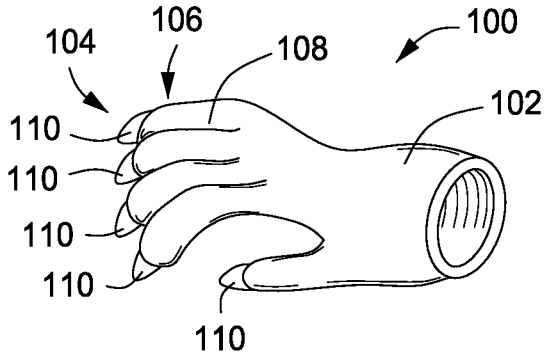
FIG. 1 is a depiction of one embodiment of a scratching device of the present invention.

Where possible, identical reference numerals are used herein to designate identical elements that are common to the figures. The images in the drawings are simplified for illustrative purposes and are not depicted to scale. The appended drawings illustrate exemplary embodiments of the invention and, as such, should not be considered as limiting the scope of the invention, which may possess other equally effective embodiments.

DETAILED DESCRIPTION

The present invention is a scratching device for scratching pets and/or humans. The scratching device generally comprises a hand cover having a means for scratching disposed proximate a terminal end of the hand cover, i.e., proximate the tips of the fingers of the user when worn. The device facilitates imitation of the human hand and scratching with excellent motor control over the means for scratching while protecting the nails and/or hands of the user.

FIG. 1 depicts a view of one embodiment of scratching device 100. The scratching device generally comprises a hand cover 102 having means for scratching 104 disposed proximate a terminal portion 106 of the hand cover 102. The hand cover may be in the form of a glove, a mitten, a partial glove or mitten, or other piece of material having suitable means for retaining the hand cover 102 in place on the user's hand. Examples of suitable means for retaining include excess material strips that may be tied together or wrapped around the hand and/or wrist of the user, hook-and-loop fasteners, elastic bands, zippers, buttons, snaps, laces, cord stoppers or cord locks, and the like. The hand cover may also be retained in place by friction, for example, as may be provided by a snug fit.

The hand cover 102 can be any size, shape, length, color, and the like and may be fabricated from any suitable material, such as fabrics, polymers, reinforced polymers, rubber, or any other material suitable for forming a hand cover. The hand cover 102 may also be flexible or rigid, and may be soft or hard. The hand cover 102 may be right-handed, left-handed, or universal (not specifically right- or left-handed). In addition, the hand cover 102 may be designed to look like a human hand, an animal's paw, an element of nature (such as a stick), or any other form including abstract forms. For example, the hand cover 102 may be made in the shape of a bear's claw, a dog's paw, a fish's fin, a clown's hand, a hand having costume jewelry, or the like.

The hand cover 102 may have five independent fingers, such as a glove; a subset of independent fingers, such as a mitten; or no distinct finger protrusions, such as a sock. In the embodiment depicted in FIG. 1, the hand cover 102 is in the form of a glove having five fingers 108. It is contemplated that gloves having other numbers of fingers may also be utilized, for example, a glove having three or four fingers. It is further contemplated that hand covers having greater than five fingers may be utilized wherein two or more fingers of the hand cover may be controlled by a single finger of the user.

The means for scratching 104 generally comprises one or more scratching elements 110 that are generally disposed at the terminal end 104 of the hand cover 102 and/or extend beyond the terminal end 104 of the hand cover 102, thereby facilitating control of the scratching device 100 by the flexibility, mobility, and dexterity of the hand of the wearer. For example, in the embodiment depicted in FIG. 1, the means for scratching 104 comprises five scratching elements 110 that are disposed at the terminal portion 106 of the fingers 108 of the hand cover 102 in emulation of a human hand. However, even where other arrangements having a non-human configuration are utilized, the position of the means for scratching 104 at the terminal portion 106 of the hand cover 102 facilitates fine motor control over the operation of the scratching device 100.

The means for scratching 104 may be any size, length, shape, color, or material. Generally, the means for scratching 104 comprises one or more scratching elements 110 fabricated of a suitable hard material having a size and a shape that facilitates a good scratch. Examples of suitable materials include, but are not limited to, plastic, resin, wood, and the like and combinations thereof. The shape of the scratching element 110 of the means for scratching 104 may emulate a human fingernail or may take some other shape having an edge that provides a good scratch. Examples of such shapes include, but are not limited to, flat, arcuate, wavy, jagged, and the like. Although not precluding the use of sharp edges, care should be taken in providing or using a means for scratching 104 having an edge that is sharp in order to avoid potential injury to the pet or the user.

The means for scratching 104 may be attached to the exterior of the hand cover 102 or the interior of the hand cover 102. The means for scratching 104 can be attached to the hand cover 102 in any suitable manner, for example, by gluing, bonding, adhering, sewing, tying, or the like, or by suitable fasteners, such as hook-and-loop, snaps, buttons, or the like. Alternatively or in combination, the means for scratching 104 may be inserted into the hand cover 102 such that the scratching elements 110 are disposed proximate and protrude from the terminal portion 106 of the hand cover 102.

Figure 2A:
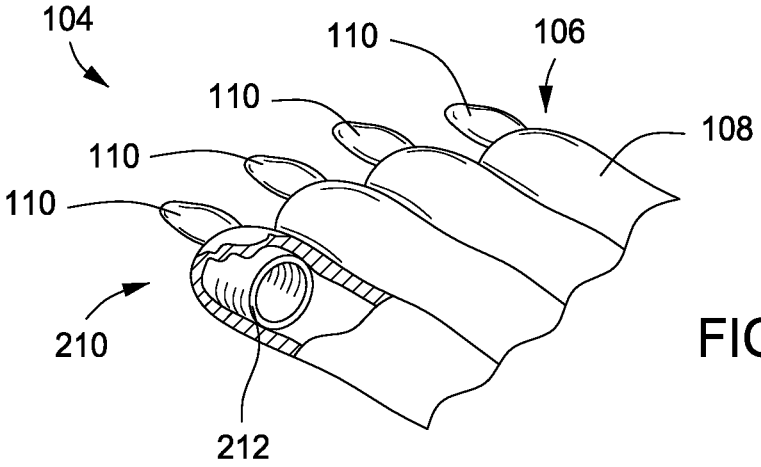
FIGS. 2A-B and 3 depict optional embodiments of the scratching device.

Optionally, one or more internal structures may be formed inside the hand cover 102 to facilitate control of the means for scratching 104. For example, portions of the terminal portion 106 of the hand cover 102 may be selectively sewn together to form regions corresponding to one or more fingers. Alternatively or in combination, additional material or inserts (e.g. one or more bodies) may be sewn into or placed inside the hand cover 102 in regions corresponding to one or more fingers to facilitate control of the means for scratching 104. In one embodiment, depicted in FIG. 2A, an insert 210 may be a cap or a tube 212 comprising plastic, paperboard, or other suitable material disposed in the terminal portion 106 of the hand cover 102, for example, within the fingers 108.

Figure 2B:
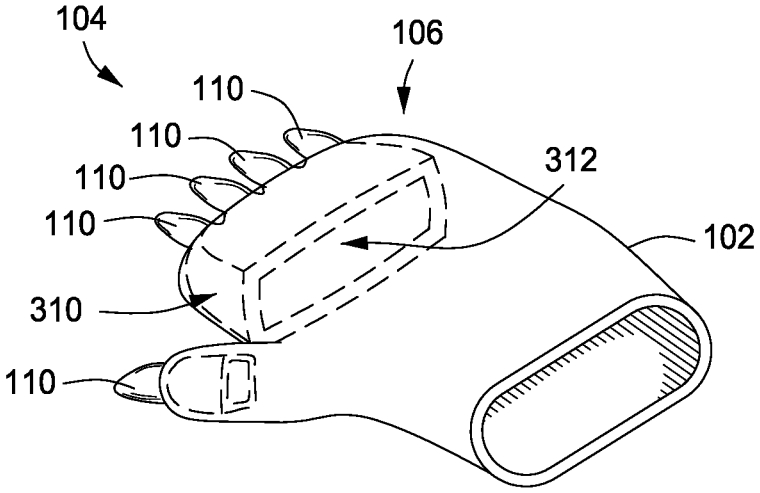

Alternatively, and as depicted in FIG. 2B, an insert 310 having one or more holes 312 for receiving one or more of the user's fingers when worn may be disposed within the hand cover 102. The insert may be fixed to the hand cover 102, e.g., sewn or adhered to the hand cover 102, or the insert may be removable. It is contemplated that the insert may optionally be an integral part of the means for scratching 104, rather than a separate component.

Figure 3:
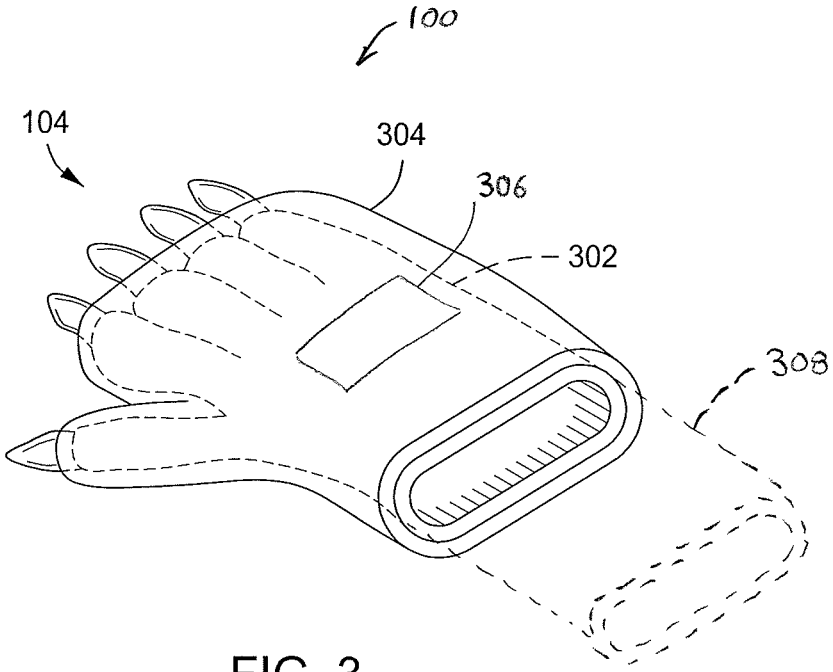

The scratching device 100 may further be customizable. For example, the hand cover and/or the means for scratching may be fabricated of materials that may be colored, shaped, arranged, or otherwise altered by the end user. For example, the scratching elements of the means for scratching may be painted or colored using a colorant, such as nail polish, or may be shaped using an emery board or other shaping tool. Alternatively or in combination, additional elements may be attached to the hand cover 102 for decoration or additional protection. For example, an extension sleeve (e.q., 308 in FIG. 3) may be attached to the hand cover 102 to extend up and cover the arm of the user. The hand cover 102 may further comprise an inner cover (e.g., 302 in FIG. 3) similar as described above and an outer cover (e.g., 304 in FIG. 3) that fits over the inner cover and allows the means for scratching 104 to protrude therefrom. The outer cover may serve as a decorative element. The outer cover may further be removable to facilitate changing designs or for replacing when worn or dirty (e.g., for cleaning).

In addition, optional features may be added to the scratching device 100. For example, a de-shedding attachment, a massaging attachment, a comb or brush attachment, or the like, may optionally be attached to the front or backside of the wrist or forearm, the palm region, along the fingers of the hand cover 102 beneath the means for scratching 104, and/or on the backside of the hand, and the like (e.g., attachment 306 depicted on the backside of the outer cover 304 in FIG. 3). When extending along the fingers, the optional attachments are disposed below the means for scratching 104 of the scratching device so as to operate independently of and not to interfere with the scratching operation of the scratching device 100.

Thus, a scratching device has been provided that facilitates giving a pet or other person a good scratch. The scratching device enables scratching even if the user does not have lengthy fingernails of their own. The scratching device further advantageously avoids touching the pet being scratched for persons allergic to animals and/or concerned with getting their own fingernails dirty.

While the foregoing is directed to certain embodiments of the present invention, other and further embodiments of the invention may be devised without departing from the basic scope thereof, and the scope thereof is determined by the claims that follow.

What is claimed is:

1. A scratching device, comprising:

a hand cover having an inside for receiving a hand and fingers of a user;

a means for scratching extending from a terminal end of the hand cover wherein the means for scratching include three or more scratching elements comprising at least one of plastic, resin, or wood; and an insert disposed inside of the hand cover and having one or more holes configured to receive one or more fingers of a user of the device for facilitating control of the means for scratching.

2. The device of claim 1, wherein the hand cover is configured as a glove.

3. The device of claim 2, wherein the means for scratching includes five or more scratching elements, at least one scratching element per finger of the user, and further comprising five inserts each disposed inside of the hand cover and configured to receive one finger of the user to facilitate control over the scratching elements of the means for scratching.

4. The device of claim 1, wherein the hand cover is configured as a mitten.

5. The device of claim 1, wherein the hand cover is decorated to resemble one of a human hand, an animal's paw, or an element of nature.

6. The device of claim 1, wherein the hand cover further comprises:

a replaceable outer cover configured to fit over the hand cover and having at least a portion of the means for scratching protruding therefrom.

7. The device of claim 1, further comprising:

an extension sleeve attached to the hand cover and configured to cover the arm of the user.

8. The device of claim 1, further comprising:

one or more of a de-shedding attachment, a massaging attachment, or a comb or brush attachment attached to a front or backside of a wrist, a forearm, or a palm region, along the fingers of the hand cover beneath the means for scratching, or on a backside of the hand.

9. The device of claim 1, wherein the insert includes one hole configured to received a plurality of fingers of the user.

10. A scratching device, comprising:

a hand cover having an inside for receiving a hand and fingers of a user;

three or more scratching elements extending from a terminal portion of the hand cover in a region corresponding to the tips of fingers of a user of the device, wherein the scratching elements do not have sharp edges; and one or more bodies coupled to the scratching elements and disposed inside the hand cover, the one or more bodies having one or more holes configured to receive one or more fingers of a user of the device.

11. The device of claim 10, wherein the hand cover is decorated to resemble one of a human hand, an animal's paw, or an element of nature.

12. The device of claim 10, wherein the hand cover further comprises:

a replaceable outer cover configured to fit over the hand cover and having at least a portion of the scratching element protruding therefrom.

13. The device of claim 12, wherein the outer cover is decorated to resemble one of a human hand, an animal's paw, or an element of nature.

14. The device of claim 10, wherein the hand cover is configured as a glove.

15. The device of claim 14, wherein the three or more scratching elements comprises five or more scratching elements, at least one scratching element per finger of the user, and wherein the one or more bodies comprises five bodies, each body respectively coupled to different ones of the five or more scratching elements.

16. The device of claim 10, wherein the three or more scratching elements comprises four or more scratching elements.

17. The device of claim 10, wherein the three or more scratching elements comprises five or more scratching elements.

18. The device of claim 10, wherein the hand cover is configured as a mitten.

19. The device of claim 10, wherein the one or more bodies comprises one body having one or more holes configured to received a plurality of fingers of the user.

20. A scratching device, comprising:

a hand cover having one or more internal regions corresponding to one or more fingers of a user of the device;

three or more scratching elements extending from respective terminal portions of the internal regions of the hand cover, wherein the scratching element comprises at least one of plastic, resin, or wood; and one or more bodies, each body having a length such that the body extends over just the fingers of a user, the one or more bodies coupled to one or more of the scratching elements to facilitate control of the scratching elements and disposed inside the hand cover, the one or more bodies having one or more holes configured to receive one or more fingers of a user of the device.

21. The device of claim 20, wherein the hand cover is decorated to resemble one of a human hand, an animal's paw, or an element of nature.

* * * * *